US005813373A

United States Patent [19]

Schlossarczyk et al.

[11] Patent Number: 5,813,373

[45] Date of Patent: Sep. 29, 1998

[54] TWO-STROKE INTERNAL COMBUSTION ENGINE WITH FLUSHING CHANNELS

[75] Inventors: Jörg Schlossarczyk, Winnenden; Axel Klimmek, Schwaikheim; Peter Pretzsch, Schorndorf, all of Germany

[73] Assignee: Andreas Stihl AG & Co., Waiblingen, Germany

[21] Appl. No.: 852,680

[22] Filed: May 7, 1997

[30] Foreign Application Priority Data

May 7, 1996 [DE] Germany ..... 196 18 266.2

[51] Int. Cl.[6] ..... F02B 33/04

[52] U.S. Cl. ..... 123/65 P

[58] Field of Search ..... 123/65 P, 65 PE

[56] References Cited

U.S. PATENT DOCUMENTS

| | | | |
|---|---|---|---|
| 4,329,948 | 5/1982 | Fujikawa et al. | 123/65 P |
| 5,086,734 | 2/1992 | Nakai | 123/65 P |
| 5,134,976 | 8/1992 | Towner et al. | 123/65 PE |
| 5,251,580 | 10/1993 | Torigai | 123/65 P |
| 5,361,731 | 11/1994 | Tanaka | 123/65 P |
| 5,471,960 | 12/1995 | Nagao et al. | 123/65 P |

*Primary Examiner*—David A. Okonsky
*Attorney, Agent, or Firm*—Robert W. Becker & Associates

[57] ABSTRACT

A two-stroke internal combustion engine for a hand-guided working tool has a cylinder with a cylinder wall and a piston reciprocating in the cylinder and defining a combustion chamber with the cylinder wall. Transfer parts, each having an outlet window, for introducing combustion air and fuel into the combustion chamber are provided. The outlet windows are cut into the cylinder wall for connecting the transfer parts to the combustion chamber. The outlet windows have limiting edges extending parallel to a central cylinder axis of the cylinder and are located within an inner mantle surface of the cylinder wall. The outlet windows have a window width measured in a circumferential direction of the inner mantle surface. The transfer parts have a channel width measured in the circumferential direction of the inner mantle surface, whereby the window width is greater than the channel width. The transfer parts have a transition portion into the outlet windows. The transfer parts have a flow stall edge at an end of the transition portion remote from the outlet windows. The flow stall edges extend parallel to the central cylinder axis.

14 Claims, 3 Drawing Sheets

TWO-STROKE INTERNAL COMBUSTION ENGINE WITH FLUSHING CHANNELS

BACKGROUND OF THE INVENTION

The present invention relates to a two-stroke internal combustion engine, especially for a hand-guided working tool such as a motor chainsaw, a cutter, a trimmer etc., comprising a cylinder with combustion chamber and transfer parts arranged within the cylinder wall and opening into the combustion chamber for guiding combustion air and fuel into the combustion chamber. The outlet windows of the transfer parts have limiting edges extending substantially in the direction of the central cylinder axis whereby these limiting edges are positioned within the inner mantle surface of the cylinder wall.

In two-stroke internal combustion engines the fuel/air mixture is introduced into the combustion chamber via so-called transfer parts which are open toward the crank case and communicate with outlet windows provided within the cylinder wall. The outlet windows, like the exhaust window and the intake window, are controlled by the reciprocating piston within the cylinder. The exhaust window is opened before the outlet windows of the transfer parts are opened so that the combustion (exhaust) gases which are under pressure can be exhausted from the combustion chamber. At a later point in time, while the exhaust window is still open, the outlet windows of the transfer parts are opened so that fresh fuel/air mixture can be introduced into the combustion chamber and the remaining combustion gases (exhaust gases) can be displaced and exhausted through the exhaust window. In this design it cannot be prevented that a portion of the freshly introduced fuel/air mixture will exit via the exhaust window. This is not only disadvantageous with respect to the exhaust gas quality but also results in increased fuel consumption. To improve this design, the transfer parts and their outlet windows are arranged such and aligned such that the flow of the fuel/air mixture into the combustion chamber is oriented substantially onto the wall area opposite the outlet window. With such an arrangement the scavenging losses are supposedly reduced. However, it was determined that a considerable amount of fresh fuel/air mixture still reaches the exhaust window so that considerable HC emissions will be detected.

It is therefore an object of the present invention to improve a two-stroke internal combustion engine of the aforementioned kind such that the HC proportion within the exhaust gas is reduced and the fuel consumption is lowered.

SUMMARY OF THE INVENTION

A two-stroke internal combustion engine for a hand-guided working tool according to the present invention is primarily characterized by:

A cylinder having a cylinder wall;

A piston reciprocating in the cylinder and defining with the cylinder wall a combustion chamber;

Transfer parts, each having an outlet window, for introducing combustion air and fuel into the combustion chamber;

The outlet windows cut into the cylinder wall for connecting the transfer parts to the combustion chamber;

The outlet windows having limiting edges extending parallel to a central cylinder axis of the cylinder and located within an inner mantle surface of the cylinder wall;

The outlet windows having a window width measured in the circumferential direction of the inner mantle surface;

The transfer parts having a channel width measured in the circumferential direction of the inner mantle surface;

The window width being greater than the channel width;

The transfer parts having a transition portion into the outlet windows;

The transfer parts having a flow stall edge at an end of the transition portion remote from the outlet windows;

The flow stall edges extending parallel to the central cylinder axis of the cylinder.

Preferably, the flow stall edges are formed by two abutting surfaces positioned at an angle of less than 120°, preferably less than 90°, to one another.

The angle may be an acute angle.

The flow stall edges extend substantially within a stroke range of the cylinder.

The engine may further including an exhaust window within the cylinder wall, wherein the flow stall edges are located at a side of the outlet windows proximal to the exhaust window.

The flow stall edges are preferably rounded.

The transition portions have a rounded transition wall connected to the limiting edges wherein the rounded transition wall is rounded with a radius.

Advantageously, the transition portions have a transition wall and the transfer parts have a channel wall, wherein a step is provided between the channel wall and the transition wall.

According to the present invention, the flow stall edges provided upstream of the outlet window in the flow direction is provided within the channel wall of the transfer parts. The flow stall edge ensures that the flow direction defined by the special alignment and arrangement of the flow channel and of the outlet window is ensured in operation of the combustion engine even for fast gas load changes. The incoming fuel/air mixture will enter substantially in the constructively predetermined flow direction into the combustion chamber so that fanning out of the flow is prevented and the incoming fresh air/fuel mixture cannot directly enter the exhaust window. The flow stall edge positioned within the transfer parts is of a simple design and shape-stable because it is not subjected to any mechanical loading. The limiting edges of the outlet windows extending parallel to the direction of the central cylinder axis are positioned within the mantle surface of the cylinder wall and are thus subjected to mechanical loading by the reciprocating piston. On the one hand, these limiting edges cannot be embodied with sharp edges because this could result in damage to the piston or the piston rings, but, on the otherhand, a rounded embodiment of the limiting edges of the outlet windows would cause a strong fanning of the flow (spraying) and thus a great mixture or flushing loss. The inventive arrangement of a flow stall edge within the transfer parts and a limiting edge of the outlet window within the inner mantle surface of the cylinder wall allows to provide a sharp edge for generating flow stalling without risking damage to the piston and, on the other hand, to embody a limiting edge of the outlet window such that the reciprocating piston is not at risk in regard to being mechanically damaged.

The flow stall edge within the transfer parts and the preferred simultaneous embodiment of the limiting edge of the outlet window can be performed by a simple cutting machining, such as turning-out, or can also be provided with a respective core design when casting the cylinder.

The inventive flow stall edge within the transfer parts is formed by two abutting surfaces that are positioned at an angle of less than 120°, preferably less than 90°, relative to one another. An acute angle is especially preferred for ensuring a satisfactory flow stalling.

The transfer parts are in the form of axial slots within the cylinder wall whereby the flow edges extend substantially over the stroke range of the reciprocating piston. This lowers the manufacturing expenditure.

Preferably, the flow stall edge is positioned at the side of transfer parts (outlet window) proximal to the exhaust window because a flow fanning or spraying at this location would result in great flushing losses.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

Figure 1:
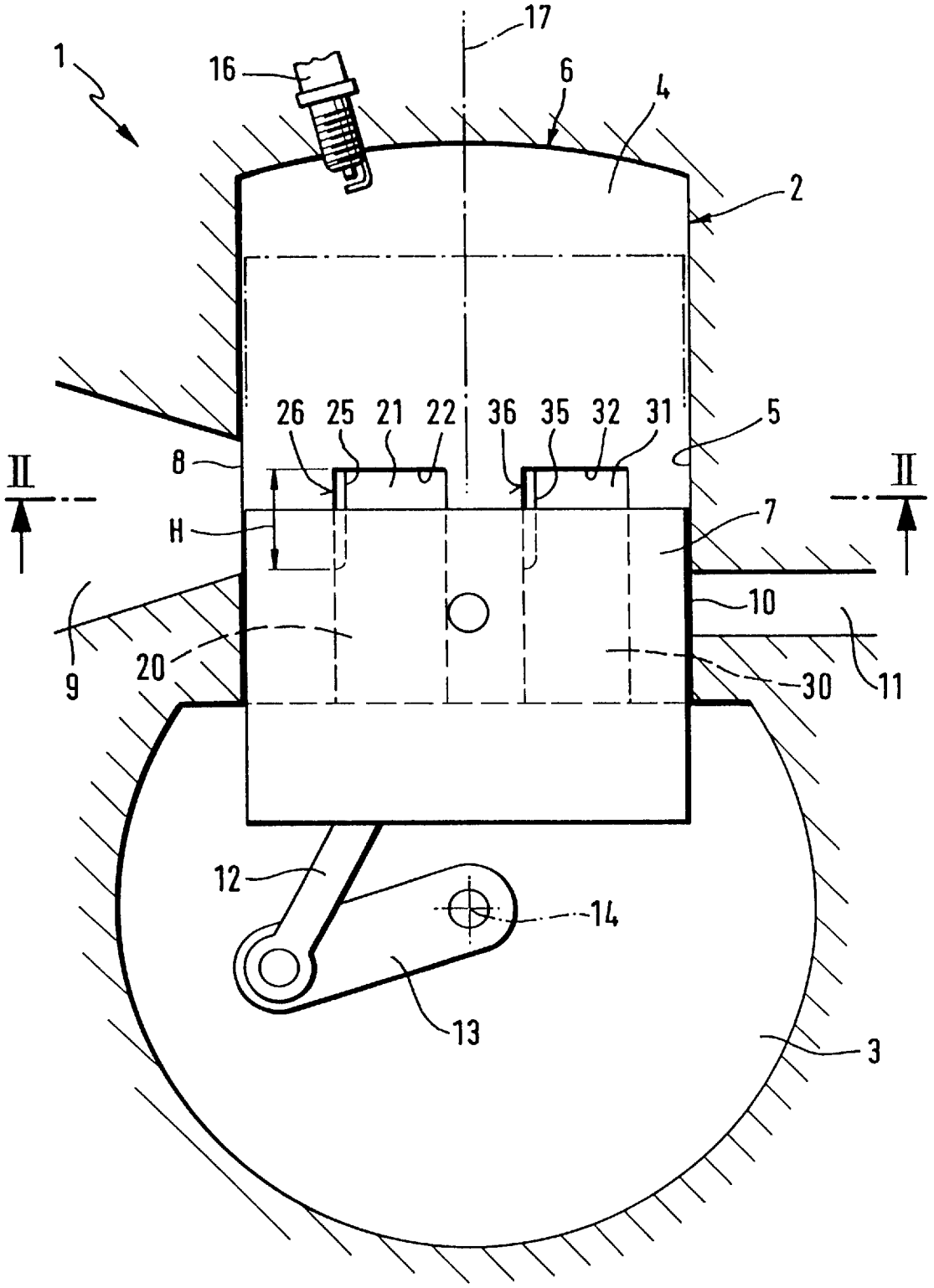
FIG. 1 is a schematic representation of a two-stroke internal combustion engine in cross-section.

The present invention will now be described in detail with the aid of several specific embodiments utilizing FIGS. 1 through 5.

The shown embodiment of the two-stroke internal combustion engine is used especially in connection with hand-guided working tools, for example, a motor chainsaw, a cutter, a trimmer etc. The two-stroke internal combustion engine 1 which is scavenged with fresh mixture of air and fuel is comprised substantially of a cylinder 2 and a crankcase 3. Within the cylinder 2 a combustion chamber 4 is embodied which is delimited in the circumferential direction by the cylinder wall 5 and which is delimit axially, on the one hand, by the cylinder head 6 and, on the other hand, by the reciprocating piston 7. Within the cylinder wall 5 an exhaust window 8 with connected exhaust gas channel 9 is provided and, at the crankcase side of the cylinder, an intake window 10 with connected intake channel 11 is provided. In the shown embodiment, the inlet channel 11 opens into the crankcase 3 from where the intake fuel/air mixture can be introduced into the combustion chamber 4 via flow channels, respectively, transfer parts 20, 30. The transfer parts 20, 30 are provided in the form of open axial slots within the cylinder wall 5 whereby their ends facing the cylinder head 6 are provided with outlet windows 21, 31. The upper control edges 22, 32 of the outlet windows 21 and 31 extending in the circumferential direction of the cylinder 2, are positioned in the shown embodiment at the same level. It may be expedient to open the transfer parts 30 remote from the exhaust window 8 earlier than the transfer parts 20 closer to the exhaust window 8 by providing a certain crankshaft angle staggering.

The outlet windows 21 and 31 as well as the exhaust window 8 and the intake window 10 are controlled by the piston 7, respectively, its piston mantle. The piston 7 is connected with a connecting rod 12 to the crankshaft 13 which rotates about the crankshaft axis 14. When the piston 7 is positioned in the upper position shown in dashed lines, the compressed mixture is ignited by the spark plug 16 positioned within the cylinder head 6. The piston 7, after passing the upper dead center, is pushed downwardly and opens first the exhaust window 8 so that the pressurized exhaust gases can exit via the exhaust gas channel 9. During the further downward movement of the piston 7, the outlet windows 21 and 31 of the transfer parts 20 and 30 open. The fresh air/fuel mixture, pressurized by the downward movement of the piston 7 within the crankcase housing 3, enters via the transfer parts 20 and 30 the combustion chamber 4 and displaces the remaining exhaust gases. During the subsequent upward movement of the piston 7, a vacuum will result in the crankcase 3 so that through the inlet (intake) window 10 and thus the intake channel 11, open because of the upward movement of the piston 7, new mixture enters into the crankcase 3 for the subsequent filling of the combustion chamber.

In the embodiment shown, on either side of a central plane 15, extending through the central cylinder axis 17 of the cylinder, two transfer parts 20, 30 are arranged. In general, other combinations are also possible, for example, only one transfer parts or three or more transfer parts on either side of the central plane 15. For diaphragm motors a fifth channel is provided.

Figure 2:
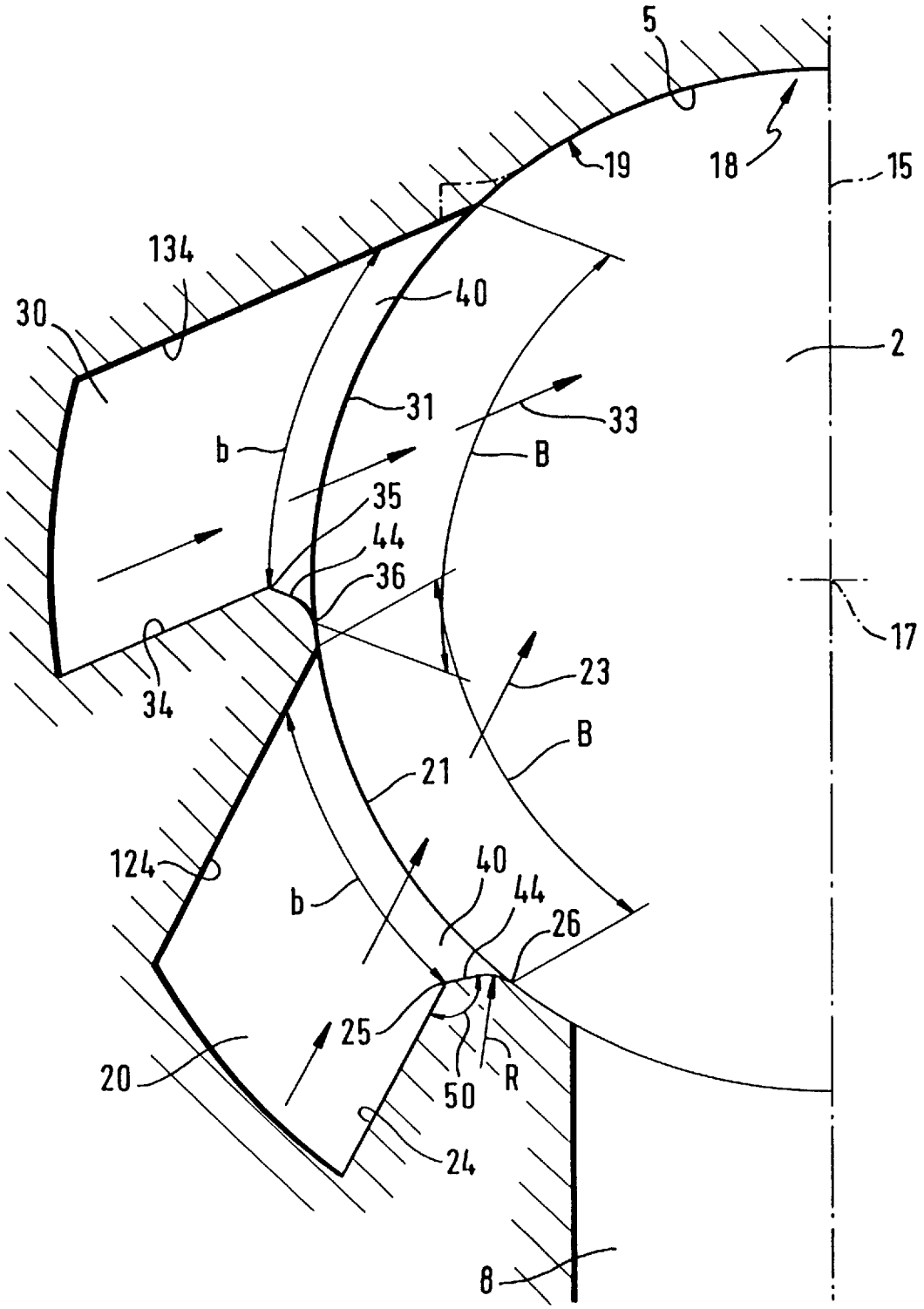
FIG. 2 is a detailed cross-sectional view along the line II—II of FIG. 1.
Figure 3:
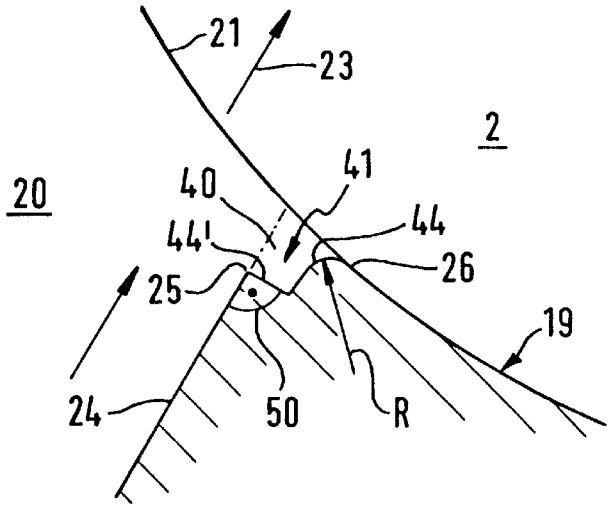
FIG. 3 shows in an enlarged representation a flow stall edge within the transfer parts.

The transfer parts 20 and 30 represented in FIG. 2 extend at an angle to the central plane 15 such that the incoming flow 23 and 33 substantially is oriented toward the wall area 18 of the cylinder wall 5 opposite the exhaust window 8. In order to provide for an uninterrupted flow into the direction of the wall area 18, it is inventively suggested to position a flow stall edge 25, 35 within the channel wall 24, 34 of the transfer parts 20, 30 so as to be proximal to the exhaust window 8. The flow stall edges 25, 35 extend substantially in the stroke direction of the piston 7. The flow stall edge 25, 26 in the shown embodiment is formed by two abutting surfaces whereby one surface is the channel wall 24, 34 of the transfer parts 20, 30 and the other surface is the transition wall 44 of the transition portion 40. The angle 50 between the two abutting surfaces 24, 34 and 44 in the shown embodiment according to FIG. 2 is less than 160°, especially less than 120°. As shown in FIG. 3, the angle 50 is preferably 90°. According to the embodiments of FIGS. 4 and 5, the angle 50 is an acute angle, i.e., is smaller than 90°.

The transition portion 40 connects the outlet windows 21, 31 to the transfer parts 20, 30 whereby the transition wall 44 of the transition portion 40 proximal to the exhaust window 8 reduces the width B of the outlet window 21, 31, measured in the circumferential direction of the cylinder wall 5, to the reduced width b of the transfer parts 20, 30. The transition portion 40 between the transfer parts 20, 30 and the respective outlet window 21, 31 thus provides an increase of the width b of the transfer parts 20, 30, measured in the circumferential direction of the cylinder wall 5, to the greater width B of the outlet windows 21, 31, whereby between the transfer parts 20, 30 and the transition portion 40 the flow stall edges 25, 35 are embodied which extend substantially parallel to the central cylinder axis 17. The oppositely arranged channel wall 124, 134 ends preferably at the mantle surface 19 of the cylinder wall 5.

As shown in FIG. 2, the outlet windows 21, 31 are wider than the cross-section of the flow channels 20, 30 only within the area of the limiting edge 26, 36 proximal to the exhaust window 8. The limiting edge 26, 36 proximal to the exhaust window 8 is rounded with a radius R. Preferably, the channel (transition) wall 44 of the transition portion 40 extends rounded with a radius R into the mantle surface 19 of the cylinder wall 5.

In the embodiment according to FIG. 3, between the channel wall 24 of the transfer parts 20 and the transition portion 40 in the area adjacent to the exhaust window 8 a step 41 is provided. The step surface 44' is positioned at a right angle 50 relative to the channel wall 24. The channel (transition) wall 44 is connected at a right angle to the step surface 44' and extends rounded with radius R into the mantle surface 19 of the cylinder wall 5.

Figure 4:
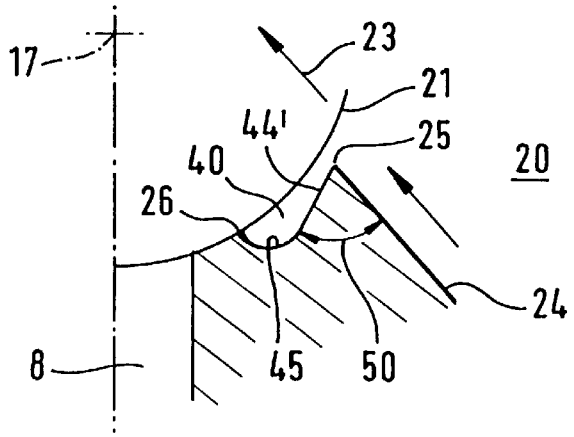
FIG. 4 shows another embodiment in a representation according to FIG. 3.

In the embodiment according to FIG. 4, the channel wall 24 of the transfer parts 20 is positioned at an acute angle 50 of less than 90° relative to the channel wall 44' of the transition portion 40. In the shown embodiment the angle 50 is 70°. The channel wall 44' has a part-circular transition 45 to the limiting edge 26 of the outlet window 21. The transition 45 is positioned at an obtuse angle to the mantle surface 19 of the cylinder wall 5.

Figure 5:
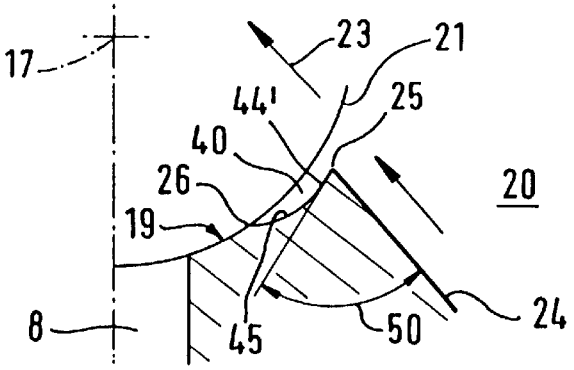
FIG. 5 is a further embodiment shown in a representation according to FIG. 3.

In the embodiment according to FIG. 5 the channel wall 24 of the transfer parts 20 is positioned at an acute angle 50 of approximately 70° to the tangentially extending surface 44' of the transition portion 40. The surface 44' has a curved portion 45 extending into the mantle surface 19 of the cylinder wall 5. An obtuse angle of approximately 170° is formed.

The flow stall edges 25, 35 positioned in the flow direction 23, 33 upstream of the outlet windows 21, 31 of the transfer parts 20, 30 are expediently not only provided at the channel walls 24, 34 of the transfer parts 20, 30 adjacent or proximal to the exhaust window 8, but also at the oppositely arranged walls 134, as shown in the embodiment of the transfer parts 30 and its wall 134 of FIG. 2.

Expediently, the flow stall edge 25, 35 extends in the axial direction of the cylinder 2 only over the height H which is within the stroke range of the piston 7.

The present invention is, of course, in no way restricted to the specific disclosure of the specification and drawings, but also encompasses any modifications within the scope of the appended claims.

What we claim is:

1. A two-stroke internal combustion engine for a hand-guided working tool, said engine comprising:

a cylinder having a cylinder wall;

a piston reciprocating in said cylinder and defining with said cylinder wall a combustion chamber;

transfer parts, each having an outlet window, for introducing combustion air and fuel into said combustion chamber;

said outlet windows cut into said cylinder wall for connecting said transfer parts to said combustion chamber;

said outlet windows having limiting edges extending parallel to a central cylinder axis of said cylinder and located within an inner mantle surface of said cylinder wall;

said outlet windows having a window width measured in a circumferential direction of said inner mantle surface;

said transfer parts having a channel width measured in said circumferential direction of said inner mantle surface;

said window width being greater than said channel width;

said transfer parts having a transition portion into said outlet windows;

said transfer parts having a flow stall edge at an end of said transition portion remote from said outlet windows;

said flow stall edges extending parallel to said central cylinder axis of said cylinder;

wherein said flow stall edges are formed by two abutting surfaces positioned at an angle of less than 120° to one another.

2. An engine according to claim 1, wherein said angle is less than 90°.

3. An engine according to claim 1, wherein said angle is an acute angle.

4. An engine according to claim 1, wherein said flow stall edges extend substantially within a stroke range of said cylinder.

5. An engine according to claim 1, further including an exhaust window within said cylinder wall, wherein said flow stall edges are located at a side of said outlet windows to said exhaust window.

6. A two-stroke internal combustion engine for a hand-guided working tool, said engine comprising:

a cylinder having a cylinder wall;

a piston reciprocating in said cylinder and defining with said cylinder wall a combustion chamber;

transfer parts, each having an outlet window, for introducing combustion air and fuel into said combustion chamber;

said outlet windows cut into said cylinder wall for connecting said transfer parts to said combustion chamber;

said outlet windows having limiting edges extending parallel to a central cylinder axis of said cylinder and located within an inner mantle surface of said cylinder wall;

said outlet windows having a window width measured in a circumferential direction of said inner mantle surface;

said transfer parts having a channel width measured in said circumferential direction of said inner mantle surface;

said window width being greater than said channel width;

said transfer parts having a transition portion into said outlet windows;

said transfer parts having a flow stall edge at an end of said transition portion remote from said outlet windows;

said flow stall edges extending parallel to said central cylinder axis of said cylinder;

wherein said flow stall edges are rounded.

7. A two-stroke internal combustion engine for a hand-guided working tool, said engine comprising:

a cylinder having a cylinder wall;

a piston reciprocating in said cylinder and defining with said cylinder wall a combustion chamber;

transfer parts, each having an outlet window, for introducing combustion air and fuel into said combustion chamber;

said outlet windows cut into said cylinder wall for connecting said transfer parts to said combustion chamber;

said outlet windows having limiting edges extending parallel to a central cylinder axis of said cylinder and located within an inner mantle surface of said cylinder wall;

said outlet windows having a window width measured in a circumferential direction of said inner mantle surface;

said transfer parts having a channel width measured in said circumferential direction of said inner mantle surface;

said window width being greater than said channel width;

said transfer parts having a transition portion into said outlet windows;

said transfer parts having a flow stall edge at an end of said transition portion remote from said outlet windows;

said flow stall edges extending parallel to said central cylinder axis of said cylinder;

wherein said transition portions have a rounded transition wall connected to said limiting edges, wherein said rounded transition wall is rounded with a radius.

8. A two-stroke internal combustion engine for a hand-guided working tool, said engine comprising:

a cylinder having a cylinder wall;

a piston reciprocating in said cylinder and defining with said cylinder wall a combustion chamber;

transfer parts, each having an outlet window, for introducing combustion air and fuel into said combustion chamber;

said outlet windows cut into said cylinder wall for connecting said transfer parts to said combustion chamber;

said outlet windows having limiting edges extending parallel to a central cylinder axis of said cylinder and located within an inner mantle surface of said cylinder wall;

said outlet windows having a window width measured in a circumferential direction of said inner mantle surface;

said transfer parts having a channel width measured in said circumferential direction of said inner mantle surface;

said window width being greater than said channel width;

said transfer parts having a transition portion into said outlet windows;

said transfer parts having a flow stall edge at an end of said transition portion remote from said outlet windows;

said flow stall edges extending parallel to said central cylinder axis of said cylinder;

wherein said transition portions have a transition wall and wherein said transfer parts have a channel wall, wherein a step is provided between said channel wall and said transition wall.

9. An engine according to claim 6, wherein said flow stall edges extend substantially within a stroke range of said cylinder.

10. An engine according to claim 6, further including an exhaust window within said cylinder wall, wherein said flow stall edges are located at a side of said outlet windows to said exhaust window.

11. An engine according to claim 7, wherein said flow stall edges extend substantially within a stroke range of said cylinder.

12. An engine according to claim 7, further including an exhaust window within said cylinder wall, wherein said flow stall edges are located at a side of said outlet windows to said exhaust window.

13. An engine according to claim 8, wherein said flow stall edges extend substantially within a stroke range of said cylinder.

14. An engine according to claim 8, further including an exhaust window within said cylinder wall, wherein said flow stall edges are located at a side of said outlet windows to said exhaust window.

* * * * *

UNITED STATES PATENT AND TRADEMARK OFFICE

CERTIFICATE OF CORRECTION

PATENT NO. : 5,813,373

DATED : 29 September 1998

INVENTOR(S) : Jörg Schlossarczyk, Axel Klimmek, Peter Pretzsch, Konrad Knaus

It is certified that error appears in the above-indentified patent and that said Letters Patent is hereby corrected as shown below:

Title page, item [75] should read as follows:

[75] Inventors:

Jörg Schlossarczyk, Winnenden;
Axel Klimmek, Schwaikheim;
Peter Pretzsch, Schorndorf;
Konrad Knaus, Gaildorf, all of Germany Signed and Sealed this Thirteenth Day of April, 1999

*Attest:*

Q. TODD DICKINSON

*Attesting Officer*

*Acting Commissioner of Patents and Trademarks*